US005269630A

United States Patent [19]

Bolin et al.

[11] Patent Number: 5,269,630

[45] Date of Patent: Dec. 14, 1993

[54] SLAB LIFTER

[75] Inventors: William B. Bolin, Ada, Okla.; William B. McCown, Jr., Allen, Tex.

[73] Assignee: Power Lift Foundation Repair, Ada, Okla.

[21] Appl. No.: 12,306

[22] Filed: Feb. 2, 1993

[51] Int. Cl.[5] ..... E02D 27/48

[52] U.S. Cl. ..... 405/230; 405/232

[58] Field of Search ..... 405/229, 230, 232, 233; 52/125.1, 742

[56] References Cited

U.S. PATENT DOCUMENTS

| | | | |
|---|---|---|---|
| 2,982,103 | 5/1961 | Revesz et al. | 61/51 |
| 3,685,301 | 8/1972 | Heacox | 405/230 |
| 3,796,055 | 3/1974 | Mahony | 405/230 |
| 3,852,970 | 12/1974 | Cassidy | 61/51 |
| 3,902,326 | 9/1975 | Langenbach, Jr. | 61/51 |
| 4,507,069 | 3/1985 | Murray et al. | 425/59 |
| 4,591,466 | 5/1986 | Murray et al. | 405/230 |
| 4,673,315 | 6/1987 | Shaw et al. | 405/230 |
| 4,708,528 | 11/1987 | Rippe | 405/230 |
| 4,765,777 | 8/1988 | Gregory | 405/230 |
| 4,800,700 | 1/1989 | May | 405/230 X |
| 4,906,140 | 3/1990 | Clark | 405/230 |
| 4,911,580 | 3/1990 | Gregory et al. | 405/230 |
| 4,925,345 | 5/1990 | McCown et al. | 405/232 |

*Primary Examiner*—David H. Corbin

*Attorney, Agent, or Firm*—Moore & Hansen

[57] ABSTRACT

An apparatus for lifting and stabilizing a structural slab overlying the ground includes a base attached to the upper surface of the slab, at least one hydraulic cylinder vertically supported from the base and a slip clamp assembly attached to the piston rod extending from the cylinder. Piling segments are sequentially passed downward through the slip clamp and through coaxial holes in the base and in the slab, and are driven into the ground by the hydraulic cylinder to form a support column under the slab. A method for using the apparatus includes the lifting of the slab to the desired elevation by actuation of the hydraulic cylinder on the support column, injection of a low-strength fill material beneath the slab, distant from the piling hole, removal of the pile driving apparatus, severing of the final piling segment and joining a cap thereto, reinsertion of the final piling segment below the slab, and injection of a high-strength grout material through the piling hole in the slab to form a monolithic bulbous load supporting member which supports the slab, outwardly from the piling hole, on the driven piling.

15 Claims, 5 Drawing Sheets

SLAB LIFTER

BACKGROUND OF THE INVENTION

This invention relates generally to apparatus and methods for lifting, supporting and stabilizing generally horizontal structures overlying a ground surface. More particularly, this invention pertains to apparatus useful in confined spaces for raising, supporting and stabilizing floor slabs and the like.

Structures such as dwellings, industrial and business buildings, etc. are subject to settling and structural deformation from unstable ground conditions. Such deformation results when the soil and subsoil differentially expand and contract because of cyclical freezing and thawing, as well as from changes in moisture content. Some geographical areas have soils which are particularly susceptible to differential movement.

Various equipment and methods for shoring and stabilizing a sagging or settling building foundation are well known.

One method which has been used is the pressurized pumping of a grout material under a building slab or foundation to lift the settled structure. Usually, the subsoil continues to expand and contract, however, and the remedy is merely temporary.

In a more recent development, a tubular piling is driven beneath or adjacent the foundation. As the piling reaches bedrock or a highly resistant soil layer, the upward reaction forces on the pile driver are directed against the bottom surface of the foundation to lift it. A bracket attached to the piling remains permanently under the foundation for continued support thereof, enabling removal of the pile driver. Typically, a plurality of pilings is driven at 6–12 foot intervals along the foundation. Such systems are typified in U.S. Pat. Nos. 3,902,326 of Langenbach, Jr. and 4,673,315 of Shaw, et al. which disclose systems having a power cylinder above or alongside the foundation level for driving the piling. In the latter reference is disclosed the lifting of a slab from the building exterior; thus, the slab must extend to the outside wall of the building for accessibility. U.S. Pat. Nos. 4,708,528 of Rippe and 3,902,326 of Langenbach, Jr. disclose apparatus for lifting slabs from the interior of buildings by hydraulic pile drivers.

The lifting of slabs of concrete or other materials differs from the lifting of foundations. Typically, such slabs have a much higher ratio of horizontal surface area to vertical thickness than foundation members. The load placed on the pile driver is considerably less because the slab is thinner and normally does not support a building structure as does a foundation. Although the reduced load permits a more. distant spacing of the supportive piling, the propensity for the slab to crack under localized lifting forces may make wider spacing unworkable. Piling locations must be carefully selected to ensure adequate support of the slab over its entire area during and following the lifting operations. This support must continue after the slab has been restored to the desired elevation. The space between the lifted slab and the ground may be filled with gravel, sand or hardenable mortar materials of various types. Prior art practice resulted in relatively local support rather than support over the entire slab, or nearly so.

Another difference between foundations and slabs exists. Slabs are not generally accessible from the exterior of a building, so the piling must be driven through holes in the slab itself. From a structural standpoint, it is desirable to limit the size of such holes. The prior art practice of forming holes sufficiently large to excavate a hole beneath the slab and install a bracket or lifting plate in the hole under the slab, as disclosed in U.S. Pat. No. 4,800,700 to May, resulted in holes having typical dimensions of 1–3 feet. Such large holes severely weaken the slab.

BRIEF SUMMARY OF THE INVENTION

The primary object of this invention is to provide apparatus and methods for lifting, supporting and stabilizing a slab overlying the ground.

A further object is to provide apparatus and methods for lifting a ground covering slab where the space available for locating the pile driver(s) and the height available for inserting the sequential pile segments therein, are very limited.

An additional object of the invention is to provide a slab lifting and stabilizing apparatus and method by which a large distorted slab may be quickly and accurately lifted to the desired position and stabilized with support extending over a major portion of its area.

A further object of the invention is to provide an apparatus and method by which relatively short hydraulic cylinders may be used to drive piling segments of lengths longer than the cylinder stroke length.

Another object of the invention is to provide apparatus and method for providing continuous local support of a ground covering slab from a driven piling while simultaneously providing ground-based support for wide areas of the slab distant from the piling.

A further object of the invention is to provide a lightweight, easily transported slab lifting apparatus.

An additional object of the invention is to provide an apparatus and method of lifting, supporting and stabilizing a ground overlying slab without forming a large hole in the slab and without excavating space beneath the slab for the slab support.

A further object of the invention is to provide a slab lifting apparatus which has parts of various sizes which are easily and quickly interchangeable to meet various operating conditions.

Another object of the invention is to provide a slab lifting apparatus which can be fabricated of readily available parts.

These and other objects and advantages of the invention will be readily understood by reading the following description in conjunction with the accompanying figures of the drawings wherein like reference numerals have been applied to designate like elements throughout the several views.

DESCRIPTION OF THE PREFERRED EMBODIMENTS

Figure 1:
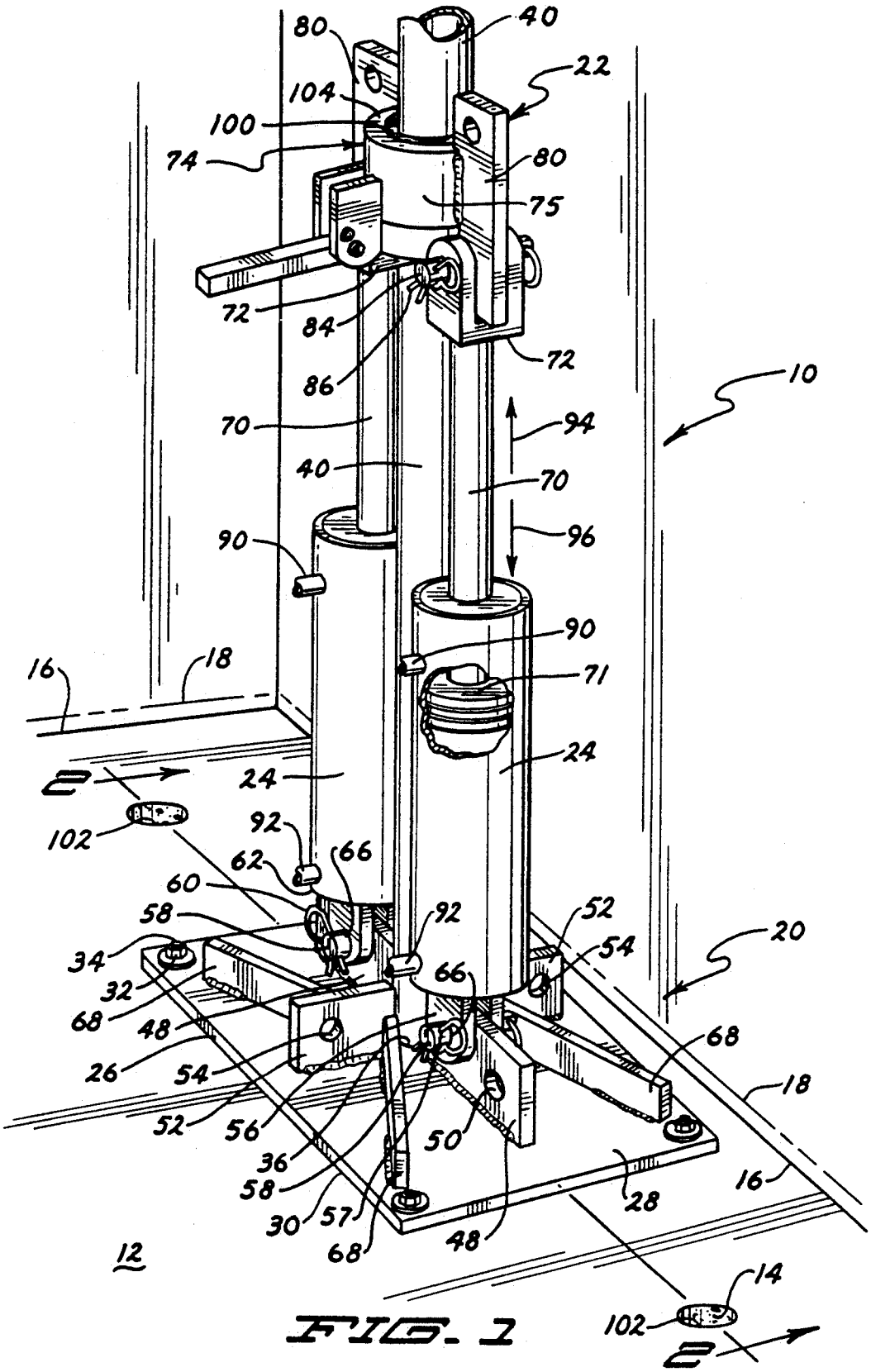
FIG 1 is a partially cutaway perspective view of the slab lifting apparatus of the invention as installed on a floor slab within a building and having piling mounted therein for a driving stroke.

With reference to the drawings, and particularly to FIG. 1, a slab lifting apparatus 10 of the invention is shown as secured to the upper surface 12 of a concrete slab 14. The slab 14 is shown at a fallen position 16 due to e.g. contraction of the ground which underlies the lower surface 13 of the slab 14. The slab 14 is to be raised, stabilized and supported at the desired level or position 18, typically the original as-built position of the slab 14.

The slab-lifting apparatus includes a pile driver base 20, a head assembly 22 and hydraulic power cylinders 24 which join the base 20 and head assembly 22. A description of each element, together with a description of the operation of the apparatus, follows.

The base 20 is illustrated as including a flat base plate 26 which has a generally rectangular upper surface 28 and coextensive lower surface 30 which overlies the upper slab surface 12. The base 20 is joined to the slab e.g. by high strength nuts 32 threaded onto bolts 34 embedded in drilled boltholes 46 in the slab 14 by well known methods. Each bolt 34 passes through a hole 44 in the baseplate 26 (see FIG. 2). While the figures depict the base plate 26 with boltholes in the corners only, additional boltholes in reinforced areas near the periphery of the base plate between the corners may be used as well.

The size of the base plate 26 is generally the minimum which will satisfactorily lift and support the slab 14 without itself bending. It is desirable that the weight of the apparatus be minimized for ease of portability and installation, as well as cost of construction.

The base plate 26 includes a generally central through hole 36 which is to be vertically aligned with a through hole 38 (shown in FIG. 2) formed in the slab 14.

Figure 8:
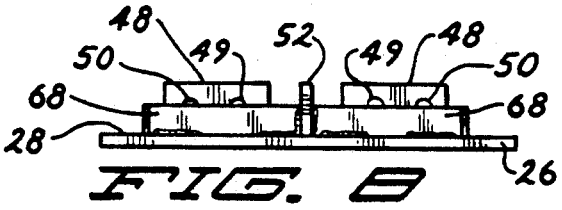
FIG. 8 is a front, elevation view of the base of the slab lifting apparatus of FIG. 7.
Figure 9:
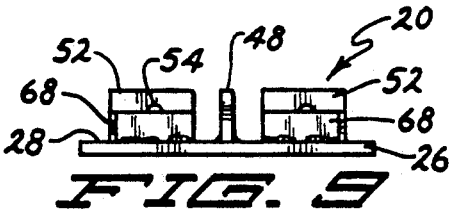
FIG. 9 is a side, elevation view of the base of the slab lifting apparatus of FIG. 7.
Figure 10:
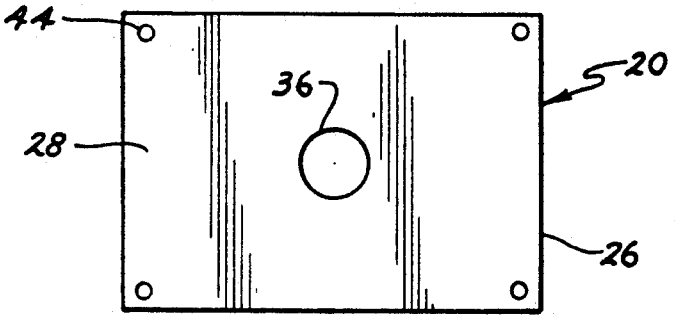
FIG. 10 is a bottom view of the base of the slab lifting apparatus of FIG. 7.

The base plate 26 includes means for attaching two hydraulic power cylinders 24 to extend upwardly on opposite sides of through hole 36 to head assembly 22. As shown, cylinder mounting plates or attachment members 48 are formed of rigid material such as metallic plate material and are fixedly mounted, e.g. as by welding, to the upper surface 28 of the base plate 26. The cylinder mounting plates 48 are preferably fixed generally in the same vertical plane and are mounted on opposite sides of the through hole 36 to minimize non-vertical forces acting on the piling segments 40. Each mounting plate 48 has an attachment hole 49 (see FIG. 8) for mounting a cylinder 24.

The embodiment of the invention shown in FIG. 1 has a second pair of cylinder mounting plates o attachment members 52 arranged at right angles to plates 48 for an alternative mounting of the power cylinders 24 where, for example, a building feature interferes with the cylinder arrangement as shown. Each mounting plate 52 is shown with a corresponding attachment hole 54.

The closed end 62 of each power cylinder 24 is connected to a mounting plate 48 or 52 so that the cylinder extends upwardly from the plate. The power cylinders 24 are depicted with clevis connectors 56 with holes 67 therethrough. A power cylinder 24 is connected to an attachment member 48 by passing a clevis pin 58 through holes 49 and 66. A cotter pin 60 may be passed through a small hole or groove 57 in the clevis pin 58 to lock the cylinder 24 to the base 20.

The bending resistance of the base plate 26 is greatly enhanced by the mounting plates 48 and 52. Further strengthening of the base plate 26 is shown by the addition of diagonal reinforcement bars 68 which span portions of the base plate 26 between each corner bolthole 44 and the central through hole 36.

Through hole 38 in the slab 14 may be formed either before or after the base plate 26 is mounted on the slab 14, but is preferably pre-formed by drilling. The diameters of holes 36 and 38 are sufficiently large to permit the passage of piling segments 40 therethrough and into the ground 42 (see FIG. 2). Typically, the diameters of holes 36 and 38 are ¼ inch up to about 3 inches greater than the piling diameter, thus enabling easy passage of the piling therethrough. As further discussed herein, a through hole 38 having a diameter of about 3½ to 4 inches or more permits manual removal of excess grout or soil from around the driven piling 41.

As already described, the power Cylinders 24 are preferably connected to the pile driver base 20 so that the piston rods 70 are movably extensible upwardly from the cylinders 24. A reciprocally moveable piston 71 within the cylinder 24 is connected to an upwardly extending piston rod 70. The distal, i.e. upper ends 72 of the piston rods 70 are connected by a head assembly 22. The head assembly 22 includes wings 80 which are connected to the upper ends 72 of the piston rods 70 by upper clevis connectors 82, clevis pins 84 and cotter pins 86. The wings 80 are attached to an annular slip clamp assembly 74 which firmly grips a piling segment 40 inserted therein. On the retraction stroke of the cylinders 24, the clamp assembly 74 strokes the piling segment 40 downward, driving it into the ground 42 beneath the slab 14. The slip clamp assembly 74 may be of any configuration which will clamp to the outer wall of the piling for driving it downward. The preferred configuration is as described in applicant's co-owned U.S. Pat. No. 4,925,345, incorporated herein by reference. The slip clamp assembly 74 is shown with a lever 98 by which semicircular wedges 100 are tightly pressed between the inverted bowl 75 and the piling segment 40 so that the segment 40 is tightly held by the bowl 75 as the head assembly 22 is driven downwardly on the drive stroke. The lever 98 is pivotally attached to the bowl 75 so that downward pressure on the lever 98 pushes the wedges 100 upwardly into the generally conical shaped bowl 75 for contact with the piling segment 40.

The power cylinders 24 are shown as pivotally attached to the base 20, and the upper ends of the piston rods 70 are pivotally attached to the head assembly 22. For using the pile driving apparatus with more than one piling diameter, alternate head assemblies 22 may be provided, each configured for driving a different diameter of piling 40.

The apparatus is configured so that each of the base 20, the cylinders 24 and the head assembly 22 may be of differing sizes, whereby various combinations may be used for particular applications. Thus, in some instances, longer cylinders 24 may be desirable, or wider cylinder spacing may be desirable for driving piling of greater diameter. The mounting plates 48, 52 may have multiple attachment holes 49, 54 to accommodate alternative cylinder spacing.

It is to be understood that pile driving assemblies utilizing hydraulic cylinders in different support arrangements than that disclosed herein may be satisfactorily utilized. For example, the arrangement shown in our U.S. Pat. No. 4,925,345 with hydraulic cylinders extending downwardly from an elevated head assembly could be used. With such a support arrangement, the support rods for the elevated head assembly would be removably secured to apertured mounting plates 48. The piling 40 is driven downward on the extension stroke rather than the retraction stroke of the pistons.

Pressurized fluid is provided for the cylinders 24 by a fluid supply system, not shown. Such systems are well known in the art. Fluid is typically supplied from a hydraulic pump through valved conduits, not shown, to upper fluid fittings 76 to drive the pistons and piston rods 70 downwardly. Pressurized fluid may likewise be supplied through valved conduits to lower fluid fittings 78 for alternatively driving the pistons and piston rods 70 upwardly for gaining a grip higher on the piling segment 40. The cylinders 24 need not have a long stroke, because a piling segment much longer than the stroke length may be driven in multiple stroke operation. The gripping location of the slip clamp assembly 74 is advanced upwardly on the pile segment 40 after each stroke. Cylinders with a stroke length as small as about 12 to 16 inches are useful in this invention. Use of a short stroke cylinder minimizes the height of the apparatus to permit longer piling segments to be inserted therein. A further advantage relates to the reduction of the distance between the clamp assembly 75 and the ground 42. The propensity for the piling column 41 to deflect is much reduced. In addition, the use of short cylinders reduces the overall weight and cost of the pile driving system.

For residential use and other uses where the slab weights may not be as large as in industrial applications, the piling column or string 41 typically comprises segments 40 of piping having 2 7/8, 3½ or 4½ inch outside diameter with ¼ inch wall thickness. Of course, the piling diameter and wall thickness may also be larger or smaller, depending upon the weight to be supported, soil condition, expected column height, etc. The pipe material may be standard steel or of corrosion resistance metal, or other strong material, for example.

The piling segments 40 for use in restricted spaces may be of various lengths such as between one and ten feet for example. For residential buildings, the ceiling is typically eight feet above the floor, and segments 40 having lengths up to about five to six feet are used with ease, depending upon the particular cylinder length used. Typically, pile segments 40 of longer length are used first, and are followed by shorter length segments. When the first segment 40A of the piling column 41 reaches a resistant layer 43 such as rock or other hard material, the force required to drive the column 41 further rapidly increases until it is greater than the force required to lift the slab 14. The reaction force from continued driving acts on the slab 14 to lift the slab. It is generally not necessary to use a long final segment 40B at this point because most slabs are to be elevated only a short distance, typically a matter of inches. Thus, when it is anticipated that the resistant layer 43 will be reached with minimal further pile driving, the next piling segment 40 to be inserted in the driver 10, if at all required, is expected to be the final segment 40B, and is preferably of short length.

Each of the piling segments 40, following the first segment 40A driven into the ground 42, has a short insert or connector 88 of smaller diameter pipe welded into its lower end to project downwardly and join the pile segment immediately below by extending into it. Thus, the segments 40 may be joined in a continuous piling column 41 by the connectors 88. If desired, the short insert or piling connector 88 may be configured to project a sufficient distance so that when the slab 14 is elevated to the desired final level, the final piling segment 40B may be pulled from the column 41 to be cut off without separating it from the next lower segment 40C. In other words, a portion of the insert or connector 88 remains in the next lower segment 40C during the cutting operation. As a result, the last segment 40B, after cutting and installation of a cap 110, is readily guided into the column 41 for easy reinsertion. For such use, the insert or connector 88 is typically of a length such that it will project from the final segment 40B into the segment 40C below it for a distance exceeding the slab thickness by at least several inches, and preferably, at least about 6 inches. In this way, the final segment 40B may be withdrawn from the ground a distance sufficient for cutting the segment, installing a cap 110, see FIG. 5, on its upper end and slipping it downward to abut the segment 40C below it, all without completely removing the insert 88 from the segment below the final segment. Preferably, the top of cap 110 is at least about 4–10 inches below the lower surface 13 of the slab 14.

Figure 2:
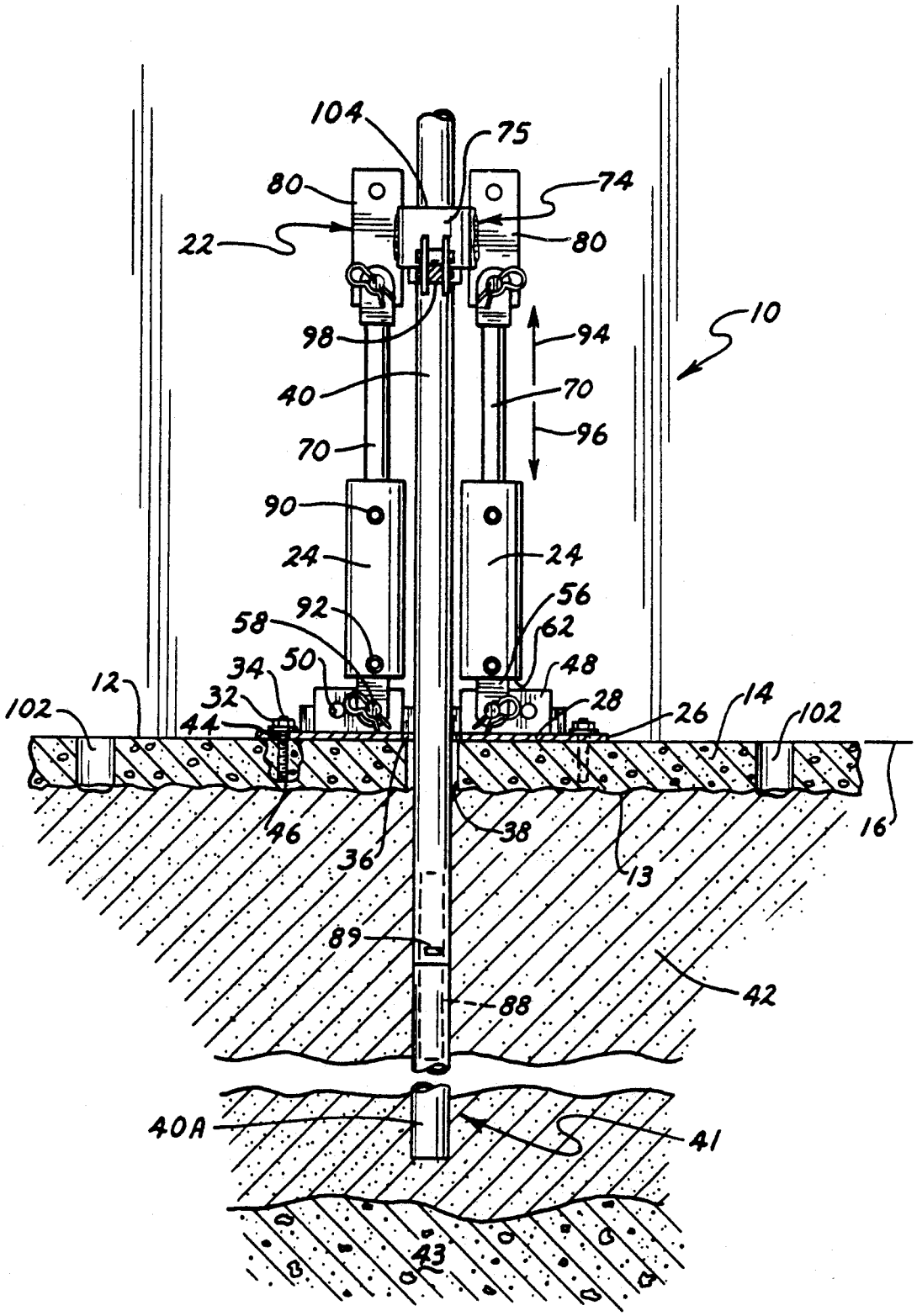
FIG. 2 is a front elevation view of the slab lifting apparatus of FIG. 1.

As shown in FIGS. 1 and 2, each cylinder 24 has high pressure fluid connections 90, 92 through which pressurized hydraulic fluid may be introduced to either side of the piston 71 for extending 94 or retracting 96 the piston rods 70. A hydraulic oil supply system such as is well known in the art may be joined by hose or tubing to the connections 90, 92. Commonly available valves may be used in the supply system for alternately and sequentially supplying high pressure fluid to both of the upper connections 90 and both of the lower connections 92. Thus, the pistons 71 and piston rods 70 of both cylinders are together motivated downwardly in retraction strokes which drive the piling segment 40 downwardly, and moved upwardly in extension strokes for moving the head assembly 22 to a new "grip" location on the segment 40. The number of drive strokes necessary to drive a segment depends upon the ratio of (a) segment length above the lowered slip clamp to (b) stroke distance.

Hydraulic power cylinders 24 of short length may be used in the pile driver 10. The maximum piling segment length which may be accommodated by pile driver 10 is generally equal to the distance between (a) the upper surface 104 of the slip clamp assembly 74 when the cylinder rods 70 are in the lowered position, and (b) the ceiling of the room. The use of short stroke hydraulic power cylinders 24 results in accommodation of long piling segments 40.

The method of lifting slabs and the like may be examplarily illustrated as follows, assuming the lifting and leveling of a large concrete slab formed on the ground.

First, the required placement of piling is determined, based on the strength, size and weight of the slab, and the amount of slab displacement to be corrected. Multiple spaced piling strings may be required.

As illustrated in FIG. 2, a hole 38 is drilled or otherwise formed through the slab 14 at each predetermined piling location for unimpeded downward passage of the piling 40 therethrough. Additional backfill holes 102 are drilled at locations distant from the piling holes 38, for subsequent introduction of low strength grout into the cavity below the raised slab. These backfill holes 102 may be of generally smaller size, typically 2 inches in diameter, and may be drilled at any time prior to introducing the low strength grout thereinto. For the sake of clarity, the horizontal distances between the piling holes 38 and the backfill holes 102 in the figures is somewhat less than normally used. Typically, the interhole distance for slabs in residences is about 4 to 10 feet, but may vary depending upon the slab weight, thickness and strength, as well as applied load. The number of backfill holes 102 is generally between 1 and 5, depending upon the interhole distance and the proximity to walls.

The pile driving apparatus 10 may be preassembled and moved into position over the piling hole 38, or may be assembled in the driving position from its component parts. Thus, the base 20 itself may be first attached to the slab 14, and then the power cylinders 24 and head assembly 22 attached to the base. Of course, as previously noted, the power cylinders 22 are also attached to a conventional hydraulic fluid pump with pressure hoses and control valves for pressurizing alternate sides of the pistons 71 within the cylinders 24. The fluid supply apparatus is configured to achieve essentially simultaneous actuation of the retraction, i.e. power strokes and of the extension strokes in both cylinders.

Assuming that the apparatus 10 is to be assembled at the pile driving site, the pile driver base 20 of the present invention is placed on the upper surface 12 of the slab 14, the base 20 having its central passage or through hole 36 aligned with through-hole 38 in the slab. The base 20 is attached at each corner and/or intermediate locations to the slab with screws or bolts 34 fastened into holes 46 drilled into the top surface of the slab. The two hydraulic power cylinders 24 are then attached to the base 20 such as by passing clevis pins 58 through the connection holes 49 in the cylinder mounting plates 48 or 54 of the base and through holes 66, and locking the clevis pins 58 with cotter pins 60 passed through holes 57 in the clevis pins. The wings 80 of head assembly 22 are then similarly attached to the upper clevis connectors 82 of the piston rods 70 with clevis pins 84 and cotter pins 86.

The upper fluid connections 90 and lower fluid connections 92 of power cylinders 24 are connected to a hydraulic fluid supply system as previously indicated.

A first piling segment 40A is then passed through the slip clamp assembly bowl 75 from the upper side 104, and downwardly through the through-hole 36 in the base 20 and through-hole 38 in the slab 14.

As previously described, the piling segment 40A is driven into the ground 42 by alternately operating the cylinders 24 in (a) a downward direction 96 while the slip clamp assembly 74 firmly holds the segment and (b) in an upward direction 94 while the slip clamp assembly 74 slides over the segment 40A. The number of full drive strokes required to fully drive the segment 40A into the ground 42 depends upon the segment length and the stroke length, and may be less than one. Multiple strokes may be required. When the first piling segment 40A is driven into the ground 42 to the extent possible, another piling segment or segments 40 having a connection insert 88 fixed in the lower end are then inserted atop the first segment 40A and likewise driven by the pile driver 10. The first piling segment 40A will at some point reach "refusal", i.e. it will reach a resistant layer 43 of ground where the required forces to further drive the piling column 41 exceed the forces required to lift the slab 14. At this point, the slab 14 will begin to rise. The length of the piling column 41 at "refusal" may vary widely depending upon the particular soil conditions.

Figure 3:
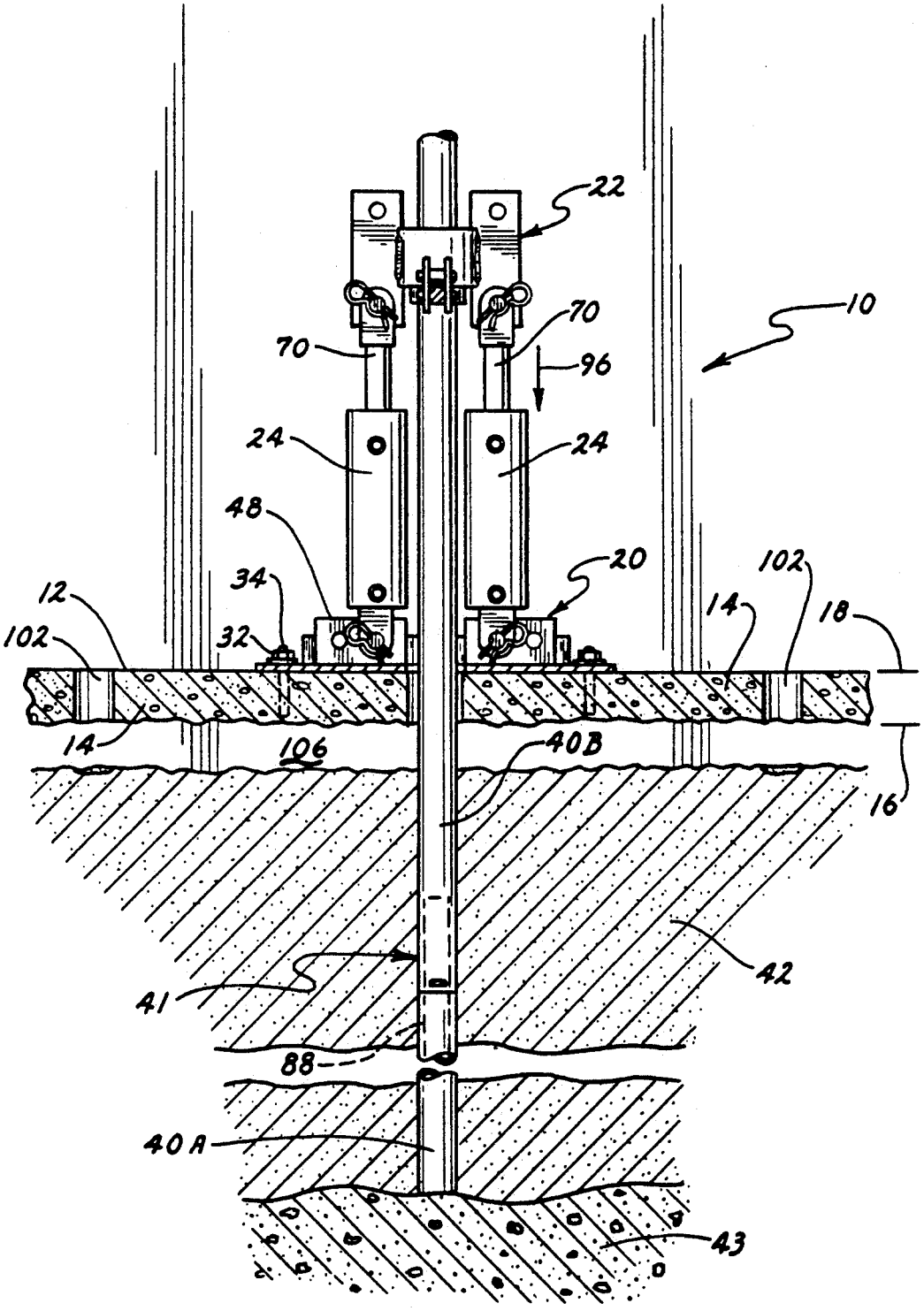
FIG. 3 is a front elevation view of the slab lifting apparatus, similar to FIG. 2 but with the slab in a lifted position.

Turning now to FIG. 3, the piling column 41 is shown as having reached a rocky layer 43 which highly resists further driving of the first or lowermost piling segment 40A. Continued operation of the power cylinders 24 in the drive direction 96 exerts an upwardly directed reaction force on the cylinders 24, the base 20 and slab 14 to lift the slab from the fallen position 16 to the desired lifted position 18. The downward pressure on the uppermost, final piling segment 40B is maintained to keep the slab 14 at the desired elevation 18. The upward movement of slab 14 creates a space or void 106 between the slab and the ground 42 upon which it formerly rested.

Figure 4:
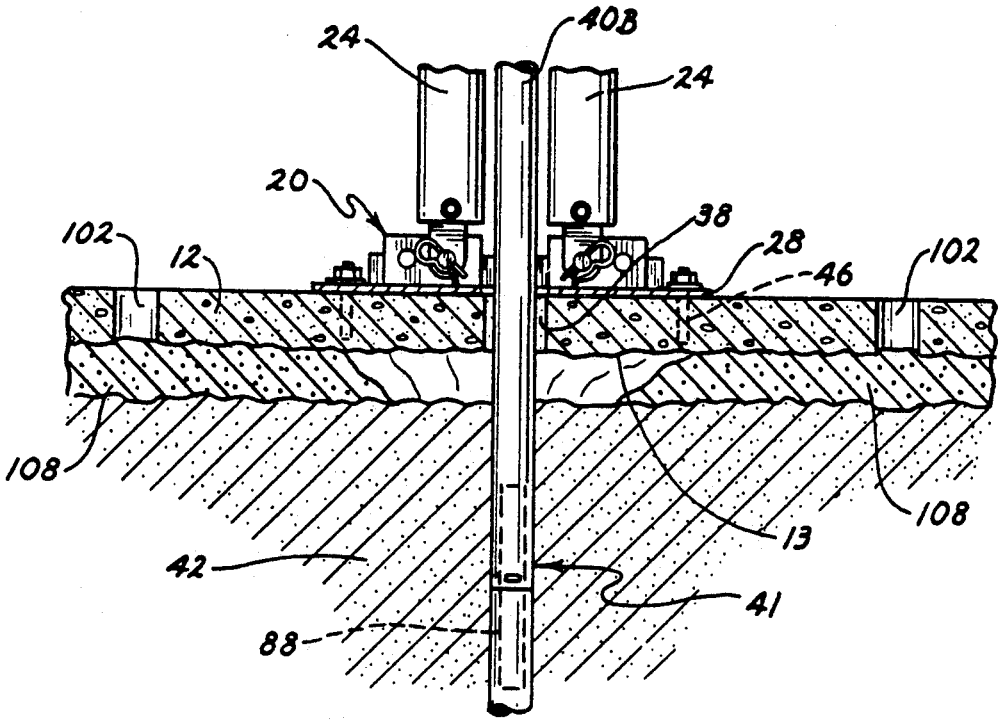
FIG. 4 is a partial front elevation view of the slab lifting apparatus as shown in FIG. 3 following the pumping of low strength grout into the slab cavity.

The next step in the process is illustrated in FIG. 4. With the slab 14 now maintained at the desired elevation 18, a low strength group material 108 is introduced through each hole 102 to fill the immediate void space about hole 102 and flow toward the piling column 41. The grout material 108 is preferably rapidly pumped at low pressure, or poured into the void 106 to closely approach the piling column 41. If the grout quantity to achieve th proximity to the column 41 is difficult to determine, the grout material 108 may be pumped through hole 102 until it begins to emerge from piling hole 38. The grout material may be a concrete or similar material, or a quick hardening plasticized cement such as commonly available epoxy grout. Preferably, an aqueous mixture of Portland cement and topsoil, fly ash or slag is used. While sand or gravel, by itself, may be used, neither is generally sufficiently fluid to flow the desired distance. Preferably, the low strength grout 108 remains in a state of loose agglomeration for a period of time after injection. The material 108 need not have a high strength because the compressive load placed on it will be broadly spread. A compressive strength of 3000 to 10,000 psf is generally sufficient. The purpose of the low strength grout 108 is twofold. First, it provides temporary slab support in the area adjacent the piling column 41 while the pile driver 10 is disconnected. Secondly, the low strength grout 108 provides a continuous semi-permanent broad base support for the slab 14 distant from the piling column 41, upon completion of the operation.

Figure 5:
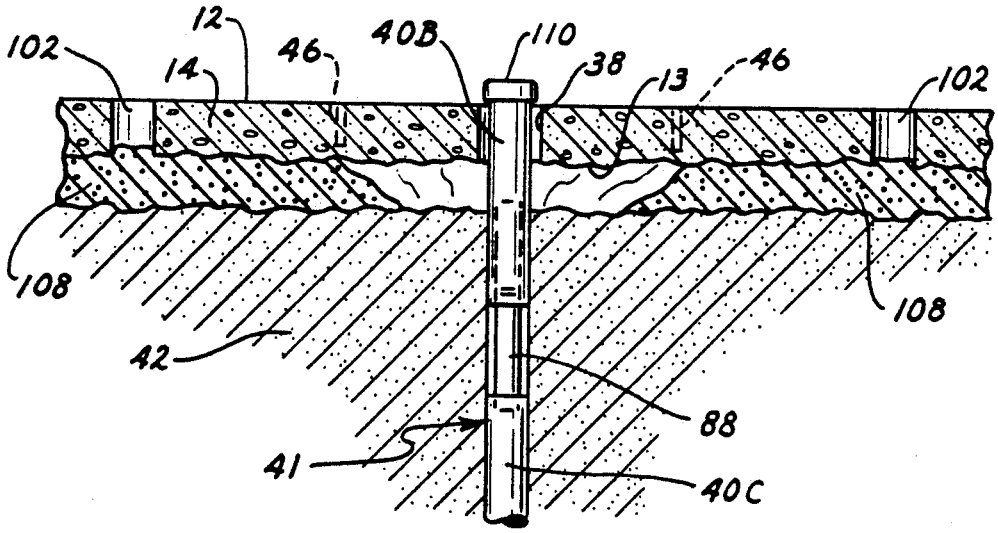
FIG. 5 is a front vertical section view of the slab and adjacent ground, after removal of the slab lifting apparatus and capping of the last pile segment.
Figure 7:
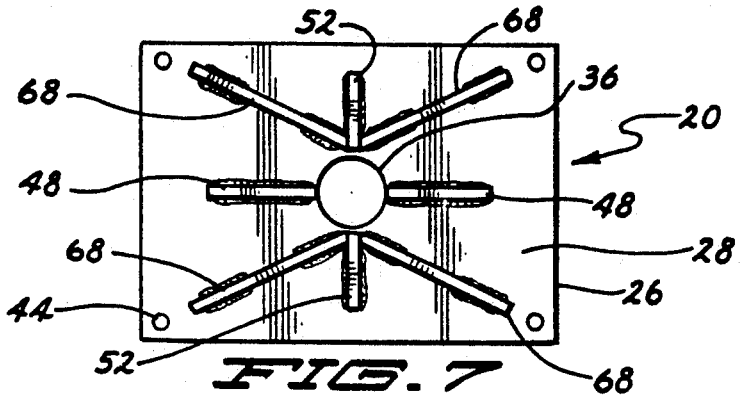
FIG. 7 is a top view of the base of the slab lifting apparatus of the invention.

Following insertion of the low strength grout 108 as a supportive material, the downward pressure on the piling string 41 is released by permitting the piston rods 70 and the head assembly 22 to extend upwardly. As shown in FIG. 5, the pile driving apparatus 10 is then removed from the slab 14 by removing the nuts 32 (see FIG. 2) from the bolts 34 embedded in the slab surface 12. The uppermost or last piling segment 40B is then pulled upward and cut off to reduce its length. A cap 110 is affixed to the upper end 112 of segment 40B. The final capped segment 40B has a length which provides a preferred spacing of about 4–10 inches from the underside 13 of the slab 14. A spacing of about 6 inches is most preferred. This cap may be a standard pipe cap or other device, typically welded to the end 112, and provides sufficient support area for long-term support of the slab 14. For example, a nominal 2⅞ inch pipe cap provides a support area of about 7 square inches. Before re-insertion of the capped segment 40B, low strength grout or soil adjacent the final position of the cap 110 is removed (e.g. by hand) so that the capped end will be subsequently enveloped in a high strength grout.

If desired, the connector 88 between the uppermost segment 40B and the next lower segment 40C is made of sufficient length so that segment 40B may be pulled up to a level which permits it to be cut off and capped, without the connector 88 losing contact with segment 40C. Following installation of the cap 110, the uppermost segment 40B may then be simply dropped back through hole 38 to abut segment 40C. The length of the capped segment 40B should be such that it lies lower than the underside 13 of the slab 14, preferably 4–10 inches lower than underside 13.

Figure 6:
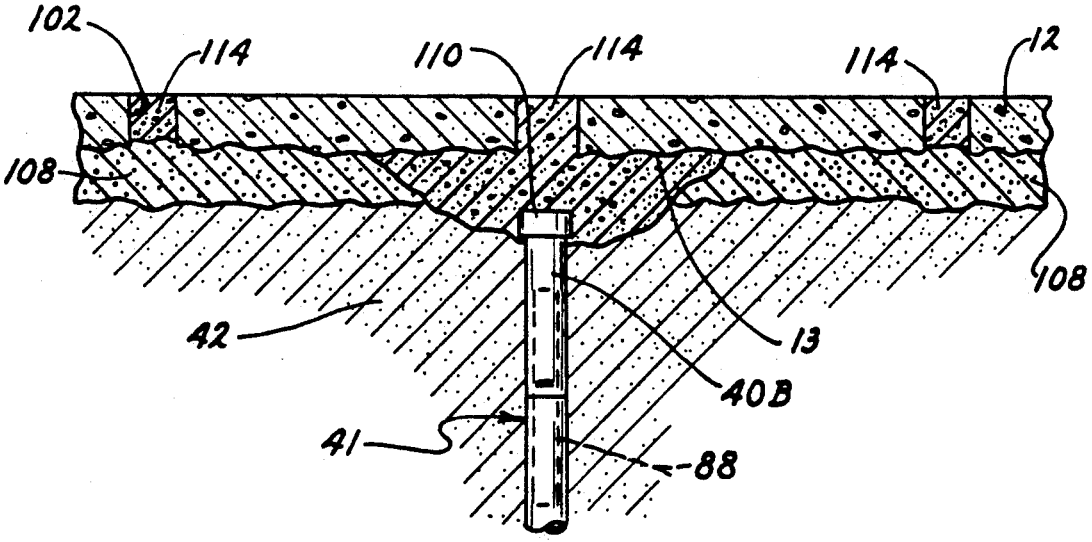
FIG. 6 is a vertical section view of the supported and stabilized slab and adjacent ground.

As illustrated in FIG. 6, a high-strength grout material 114 is then introduced through the piling hole 38 to surround and cover the upper part of the piling column 41, including the cap 110, and substantially fill the portion of the void 106 adjacent the piling column 41. The space between the cap 110 and the slab underside 13 is filled to provide a high strength bulbous load bearing member between the piling column 41 and the slab 14. Preferably, this support member of high strength grout 114 extends laterally under slab 14 to a distance of 10–20 inches from the cap 110. The slab load is transferred by this support member to the cap 110, and then to thence piling column 41. The high-strength grout may be any material which quickly sets to a permanent rigid and strong body capable of absorbing high compressive loads such as 4000–7000 psi. Readily-available epoxy grout materials may be used.

The entire piling column 41, extending downwardly to the resistant ground material 43 and having the enlarged or bulbous upper support body of high strength grout 114, provides permanent support for the slab 14.

The through-holes 102 in the slab 14 may also be filled with high strength grout 114 or other material as desired.

Due to the large area of many slabs, more than one pile driver will be used in most instances. The driver locations will be spaced to ensure that the slab is evenly supported to prevent cracking or breakage. Typically, the final lifting operation of all the drivers, after "refusal" is attained, is conducted simultaneously or nearly so to prevent structural damage (or further damage) to the slab.

Turning now to FIGS. 7–10, various views of the pile driver base 20 are shown and may be compared with FIG. 1. The base 20 includes a generally flat baseplate 26 with a central hole 36. Structure on the upper surface 28 of the baseplate 26 includes cylinder mounting plates 48 and 52 with holes 49 and 54 for attachment of power cylinders thereto, and for reinforcing the baseplate against high bending forces. Additional reinforcing bars 68 are mounted on the baseplate 26, and preferably extend generally from the location of mounting bolt-holes 44 toward the central portion of the plate 26. Holes 50 are for mounting of an alternative version of the driving cylinders.

The advantages inherent in the pile driver are several. First, a monolithic, rigid load supporting member is formed which supports an enlarged portion of the slab from the firmly driven piling column. The supporting mass of high strength grout is rigidly attached to the cap of the piling column.

Secondly, the relatively short cylinders enable the pile to be driven from a relatively low position, regardless of the length of a piling segment. Thus, the propensity for the piling segment to bend is much reduced.

Thirdly, longer piling segments may be accommodated with the apparatus than with prior art equipment driving pilings from above a slab.

Fourthly, use of this pile driving apparatus results in less damage to the slab. The size of the piling hole formed in the slab is much smaller than when an under-slab bracket is used for lifting and support.

Fifthly, this pile driving apparatus and method do not require a large bracket or other apparatus to be left in the ground beneath the slab. The only equipment left in the ground is the piling string itself including the pipe, the pipe connectors and a pipe cap. Thus, the pile driving apparatus including the base is easily removed and completely reusable.

Sixth, the pile driving apparatus is configured with interchangeable components. Thus, each of the head assembly, the power cylinders and the base may be constructed in different interchangeable sizes and configurations for accommodating different piling diameters, slab weights, slab strength, ceiling heights and the like.

Seventh, the size and weight of the pile driver is reduced for ease of handling, transportation, installation and operation.

In addition, the slab becomes supported not only from a small area immediately above the piling column(s), but over a large area surrounding the column. Secondary support is provided for distal areas by the low strength grout.

It is anticipated that various changes and modifications may be made in the construction, arrangement, operation and method of construction of the slab lifter disclosed herein without departing from the spirit and scope of the invention as defined in the following claims.

WHAT IS CLAIMED IS:

1. Apparatus for lifting, stabilizing and supporting a slab overlying ground subject to differential expansion and contraction, settling or slumping, said apparatus comprising:

a pile driver base comprising a flat base plate configured for attachment to the upper surface of a slab, said base plate having a central through-hole for generally vertical alignment with a through-hole in said slab for passage of piling segments therethrough, and securing means for attaching said base plate to said slab; and two power cylinders vertically supported from said pile driver base on opposite sides of said through-hole, said cylinders each having a piston reciprocally moveable therein and a piston rod having a first end attached to said piston and a second end extending externally of said cylinder;

clamping means connected to said second end of said piston rods for engaging piling segments sequentially inserted therethrough, said clamping means being centered over said base plate through-hole, whereby downward movement of said clamping means drives said piling segments through said aligned through-holes in said base plate and said slab and into said ground;

a head assembly joining said second end of said piston rod to said clamping means;

at least one upstanding, cylinder mounting plate on each side of central through-hole of said base plate, each said mounting plate having an aperture therethrough for removable mounting of a power cylinder; and at least one reinforcing plate on said base plate extending between said central through-hole and said securing means.

2. The apparatus of claim 1 wherein: said hydraulic cylinders have apertured extensions on their lower ends by means of which they are removably secured to said apertures on said cylinder mounting plate, with said cylinders projecting upwardly from said cylinder mounting plate and with said piston rod second ends extending upwardly to connection points with said head assembly, whereby said clamping means is pulled downwardly on the retraction stroke of said pistons into said cylinders to drive piling segments into the ground; and wherein said apparatus, when installed, accommodates piling segments of varied length up to a maximum segment length equal to the distance between said clamping means and a ceiling structure over the slab, and the maximum, useable piling segment length is not limited by the vertical distance between said clamping means and base plate in any vertical position of the clamping means.

3. The apparatus of claim 1, further comprising:

a piling column comprising elongate tubular piling segments configured to be joined and driven in sequence into said ground by said clamping means motivated by said hydraulic power cylinders; and piling connecting means for axially connecting said piling segments into a unitary piling column for driving said piling segments into said ground.

4. The apparatus of claim 3, wherein said piling connecting means comprises an elongated coupling member projecting from one end of each piling segment and extending into the next adjacent piling segment.

5. The apparatus of claim 1, wherein said securing means comprises bolts mounted in holes drilled in said upper slab surface and projecting upwardly through said baseplate, and threaded nuts screwed onto said bolts above said baseplate.

6. The apparatus of claim 1, wherein said power cylinders are pivotally joined to said pile driver base.

7. The apparatus of claim 1, wherein the stroke length of said power cylinders is less than about 24 inches and the length of said piling segments is greater than about 24 inches.

8. A method for lifting a ground supported structural slab to a higher elevation and stabilizing and supporting said slab thereat, comprising:

forming a generally vertical pile access hole through the slab, said pile access hole sized for passage therethrough of a tubular piling;

forming at least one backfill hole through said slab, said backfill hole being remote from said pile access hole and sized for introduction of a stream of low-strength grout therethrough;

removably attaching a pile-driving apparatus to the upper surface of said slab for driving piling segments downwardly through said pile access hole into the ground;

inserting a piling segment into said pile-driving apparatus and driving said piling segment downwardly into the ground through said pile access hole;

sequentially inserting further piling segments one at a time into said pile driving apparatus and driving them downwardly in a vertical column until the first piling segment strikes load bearing structure, and thereafter continuing the actuation of the pile driving apparatus on the final piling segment to raise the slab to a desired elevation above the ground, whereby a void is formed between the slab and the ground;

introducing a low strength fill material through said remote backfill hole to flow toward said piling column, and substantially fill said void to within 0 to 2 feet of said column for temporary support of the slab above said column;

thereafter removing said final piling segment from the ground and cutting off a portion of the length thereof whereby the remaining portion has a length which is wholly beneath the lower surface of the slab when rejoined to said driven piling column in the ground;

removing said low strength fill material, from the void space immediately surrounding said final piling segment beneath the slab;

attaching a cap to the upper end of said remaining portion of said final piling segment;

rejoining said capped remaining portion with said driven piling column in said ground; and introducing high strength grout through said pile access hole to envelop said cap on the driven piling column and fill the space between the cap and the slab and to harden therein for support of the slab on said piling column.

9. The method of claim 8, comprising the further step of joining connecting means to the lower end of each of said piling segments for guidable insertion into the upper end of the next lower piling segment.

10. The method of claim 8, comprising the further step of removing said pile driving apparatus from the slab.

11. The method of claim 8, further comprising the step of filling said formed holes in the slab with high strength grout.

12. The method of claim 8, wherein said low strength fill material is introduced into said remote backfill hole until it approaches to within about 0–2 feet of said piling column.

13. The method of claim 12 wherein said fill material is low strength cemetitious grout which at least partially agglomerate.

14. The method of claim 8, wherein said final piling segment is cut to a length such that its upper end will be vertically spaced at least 4 inches below the underside of the slab when said final piling segment is rejoined to the driven piling column in the ground, whereby said high strength grout will extend between the top of said final piling segment and the slab and serve to transmit the applied load of the slab to said piling column.

15. The method of claim 8, wherein said introduced high strength grout forms a bulbous monolithic load bearing member beneath the pile access hole and extending laterally therefrom a distance of at least about 10–20 inches about the pile access hole.

* * * * *

UNITED STATES PATENT AND TRADEMARK OFFICE

CERTIFICATE OF CORRECTION

PATENT NO. : 5,269,630

DATED : December 14, 1993

INVENTOR(S) : Bolin et al.

It is certified that error appears in the above-indentified patent and that said Letters Patent is hereby corrected as shown below:

Column 3, line 66, delete "o" after the word "plates" and insert -- or -- therefor.

col 4, ln 33, delete "Cylinders" and insert -- cylinders -- therefor.

col 8, ln 33, delete "group" after the word "strength" and insert -- grout -- therefor.

col 8, ln 39, delete "th" and insert -- the -- therefor.

Signed and Sealed this

Fourteenth Day of June, 1994

Bruce Lehman

*Attest:*

BRUCE LEHMAN

*Attesting Officer*

*Commissioner of Patents and Trademarks*